US005918660A

United States Patent [19]

Crawford, III et al.

[11] Patent Number: 5,918,660

[45] **Date of Patent: *Jul. 6, 1999**

[54] REPAIR AND REINFORCEMENT APPARATUS FOR OVERHEAD DOOR

[76] Inventors: Dan S. Crawford, III; Timothy A. Johnson, both of 3100 Meridian Parke Dr., Suite N, Greenwood, Ind. 46142

[ * ] Notice: This patent issued on a continued prosecution application filed under 37 CFR 1.53(d), and is subject to the twenty year patent term provisions of 35 U.S.C. 154(a)(2).

[21] Appl. No.: 08/797,353

[22] Filed: Feb. 11, 1997

Related U.S. Application Data

[60] Provisional application No. 60/011,521, Feb. 12, 1996.

[51] Int. Cl.[6] ..... E05D 15/06

[52] U.S. Cl. ..... 160/201; 49/462

[58] Field of Search ..... 160/201, 229.1, 160/206, 207, 199; 16/97, 46, 100, 106, 29, DIG. 1, DIG. 7, DIG. 20, DIG. 43; 49/462, 460, 472, 397

[56] References Cited

U.S. PATENT DOCUMENTS

| | | | |
|---|---|---|---|
| 2,434,805 | 1/1948 | Lange | 16/100 |
| 2,525,309 | 10/1950 | Norberg | 16/97 |
| 2,934,802 | 5/1960 | Shekter | 49/470 X |
| 3,047,912 | 8/1962 | Sobolewski | 49/397 |
| 3,104,699 | 9/1963 | Wolf et al. | 160/201 X |
| 3,376,913 | 4/1968 | Clapsaddle | 160/201 |
| 3,648,755 | 3/1972 | Thiele | 160/201 |
| 3,703,061 | 11/1972 | Holland et al. | 160/201 |
| 4,119,133 | 10/1978 | Wolf | 160/201 X |
| 4,284,119 | 8/1981 | Martin et al. | 160/229.1 X |
| 4,492,067 | 1/1985 | Martin et al. | 160/229.1 X |
| 4,825,509 | 5/1989 | Mitchell et al. | 16/DIG. 43 X |
| 5,031,946 | 7/1991 | Yarrow | 49/462 X |
| 5,076,626 | 12/1991 | Tiddy et al. | 49/460 X |
| 5,168,669 | 12/1992 | Knapp | 49/470 X |
| 5,188,163 | 2/1993 | Schwartzengraber et al. | 160/201 X |
| 5,240,216 | 8/1993 | Lin et al. | 160/201 X |
| 5,353,473 | 10/1994 | Sherick | 16/97 |
| 5,404,927 | 4/1995 | Bailey | 160/201 |
| 5,566,509 | 10/1996 | Long | 49/462 |

OTHER PUBLICATIONS

Photograph of G & D Model No. GD 702.

*Primary Examiner*—David M. Purol
*Attorney, Agent, or Firm*—Brinks Hofer Gilson & Lione

[57] ABSTRACT

A repair and reinforcement apparatus having a sleeve-like structure embracingly encompasses a portion of a door panel for an overhead door, having a thickness corresponding to an insulated or uninsulated panel construction. The door sleeve includes a generally U-shaped construction having front and rear flanges extending from a transverse web portion for bracketing the damaged panel portion and adjacent undamaged portions of the door panel. Selectively located notches and recesses provided in the sleeve flanges are shaped to receive corresponding tabs and fasteners of roller hinge attachment apparatus, to effect speedy repair and replacement of damaged portions of the door panel in an in situ installation.

13 Claims, 4 Drawing Sheets

REPAIR AND REINFORCEMENT APPARATUS FOR OVERHEAD DOOR

RELATED PRIORITY APPLICATION

This application claims the benefit of U.S. Provisional Application No. 60/011,521, filed Feb. 12, 1996.

FIELD OF THE INVENTION

This invention relates generally to repair and reinforcement of overhead doors, and more particularly to a repair and reinforcement apparatus for overhead doors including overhead doors having track-engaging rollers for enclosing mobile and stationary cargo bays.

BACKGROUND OF THE INVENTION

Overhead doors for use with mobile trailers for over-the-road trucks and utility vehicles, as well as for stationary applications, are well known and widely used. Typically, such overhead doors are commonly placed at the loading end of a cargo bay of a trailer or of a stationary cargo bay such as a garage or storage locker and are sized and shaped to enclose an expansive opening having significant height and width dimensions. Typically, such overhead doors are constructed of wood, fiberboard composite, or sheet material such as sheet metal. As is well known in the art, such construction offers good structural stability and generally weather resistant qualities. In the installed condition, overhead doors are fabricated with a plurality of horizontally arranged panel portions or slats engaged in a contiguous arrangement at the opposing upper and lower horizontal edges thereof so as to provide an articulating door structure which may be rolled into a overhead compartment of the trailer to which it is installed. Such doors also include track-engaging rollers at the outboard vertical edges of the panel portions and are slidably or rollably engaged with parallel tracks mounted adjacent to and frame the vertical extent of the opening of the loading end of the trailer.

During opening and closing operations and in the open and closed positions, overhead doors and especially the track-engaging rollers and attachment hardware therefor are subject to high loading and retention forces, and are further subjected to continuing shock and vibration loads in the case of mobile applications such as during over-the-road transport. When the door is in the closed position, the track-engaging rollers are subject to transverse loadings caused by shifting loads imparting substantial loads against the closed door. Furthermore, such overhead doors and their roller apparatus are subject to impact loading with objects extending in the path of the closing or opening door. Furthermore, overhead doors of the prior art construction are subject to harsh environmental factors including humidity, heat and cold, all of which over time compromise the structural integrity of the material from which the door is fabricated.

In view of the above, overhead doors, and especially those portions of the overhead door panels to which track-engaging rollers are affixed, are subject to failures and weaknesses at those areas subject to stress, especially in the areas of the track-engaging rollers and other attachment hardware. Such failures and weaknesses result in cracks, separations and deterioration of the panel portions supporting the track-engaging rollers and attachment hardware.

In particular, it is not uncommon for trailer overhead door panel portions to require regular and even daily repair or replacement due to weakened and broken lower panel corners resulting in the breakage or loss of the rollers affixed thereto, or of intermediate panel portions which are likewise affected by adverse environmental and service conditions such that interconnecting hinges and underlying panel sections are damaged or separated from the door structure. Accordingly, such damage has heretofore upset tight shipping schedules by removing the trailer from service for a period of hours or even days until repairs or replacement may be made to damaged door panel portions or related hardware. This problem is especially critical in view of rigorous scheduling requirements whereby trailers are under demanding time schedules and loads must be delivered on time, providing little or no time for replacement or repair of such damaged portions of the overhead doors. In the instance where such repair or replacement is essential to the integrity to the trailer, the affected trailer is typically remove from fleet service for a matter of hours during which time a panel portion or even the entire door is removed for repair or replaced with another door portion.

One approach to overcoming this problem involves the time-consuming procedure of removing the damaged portion of the door together with the mounting hardware and custom fitting a handcut piece of sheet material such as sheet metal to the door portion in need of repair. Although such damage to be repaired is generally confined to the particular lower corners of the doors or to the attachment points of the hardware at intermediate sections of the overhead doors, each repair using this patching method necessarily requires time to custom cut and fit the sheet material patch to the damaged area followed by attachment of the roller hardware to the patched area. Accordingly, this prior art patching method is time-consuming and generally non-uniform in appearance and, without any uniformity in such patching repair, offers a non-standard repair in virtually every repair situation, thereby compromising strength and aethetic requirements originally designed into the door and roller apparatus. Another approach is the replacement of the entire affected panel portions which require maintaining a stock of such panel portions for every type of door in the trucking company's inventory, and a substantial period of down time for the trailer while the panel portion(s) is located and transported to the repair location at which time the damaged panel portion(s) are replaced as necessary.

Thus, it is desirable to provide a repair and reinforcement apparatus for an overhead door which provides uniform repair and reinforcement characteristics with a minimum of down time at a minimal cost investment in both materials and labor, and to provide such repair and reinforcement apparatus for in situ installation with a minimum amount of downtime and inconvenience to the trucking operator.

SUMMARY OF THE INVENTION

In view of the foregoing, it is an object of the present invention to provide a repair and reinforcement apparatus for a damaged panel portion of an overhead door.

It is another object of the present invention to provide a repair and reinforcement apparatus applicable to the bottom corner portions of the lower door panel of an overhead door.

It is yet another object of the present invention to provide a repair and reinforcement apparatus for intermediate panel portions of an overhead door.

It is a further object of the present invention to quickly and inexpensively provide means for repairing a damaged overhead door, for the expeditious repair of the door in mobile transport and stationary installations of the overhead door.

It is yet another object of the present invention to provide means for expeditiously repairing damaged panel portions and associated hardware of trailer overhead doors to enable speedy return of the truck to service.

These and other objects are accomplished according to the present invention by providing a repair and reinforcement apparatus having a sleeve-like structure to embracingly encompass a portion of an overhead door panel in need of repair or reinforcement so as to effect a ready repair of the damaged door panel and eliminating the need to remove the overhead door during the repair or to remove the trailer from service for any substantial period of time. The door sleeve according to a preferred embodiment includes a one piece generally U-shaped construction having front and rear walls extending from a transverse web portion for embracing and encompassing front and rear faces of a damaged panel portion. According to some of the disclosed embodiments, the front wall of the door sleeve is configured with one or more notches for accommodating fixed and moving portions of hinges and roller to be affixed thereto. All of the disclosed embodiments include a plurality of pre-drilled holes that fit left side or right side installations, thereby assuring parts availability and universal application.

According to the invention, repair of the damaged door panel(s) is achieved by removing the damaged section of the door panel portion and any roller and hinge hardware affixed thereto, installing the sleeve in an embracing relationship over the damaged door section and fastening it thereto by installing suitable fasteners through the pre-drilled holes, or supplementing the pre-drilled holes as necessary to effect a customized installation. The roller and retention/hinge hardware are then re-affixed to the repaired door panel portion by installing a tab of the retention/hinge hardware into a slot formed in the front wall of the door sleeve, and fastening the opposite end of the hinge to the door sleeve with a fastener extending through corresponding opposing pre-drilled holes formed in the front and rear walls of the door sleeve to secure the roller in an operational position. Accordingly, such installation completes the repair and reinforcement of the damaged door panel portion(s) and enables the immediate return of the trailer to service operation.

These and other objects, features and advantages of the present invention will be more apparent in the following description of presently preferred embodiments taken in conjunction with the accompanying drawings.

DETAILED DESCRIPTION OF THE INVENTION

Figure 1:
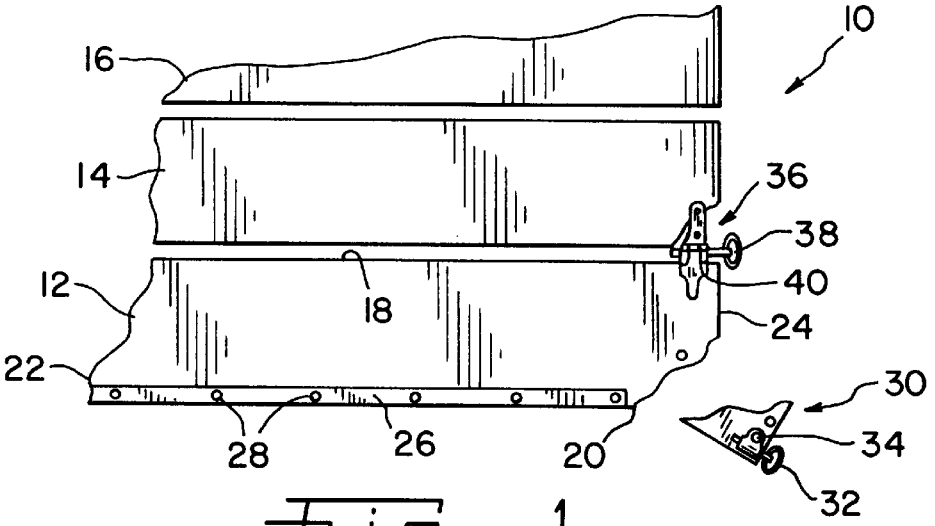
FIG. 1 is a perspective elevational view of a portion of an overhead door showing an exemplary damaged corner of a lower panel portion and a damaged intermediate portion of two door panel portions of the overhead door.

Referring to the drawings, an overhead door assembly indicated generally by the reference numeral 10 includes an assembly of a plurality of door panel portions including a bottom panel portion 12, at least one intermediate panel portion 14, and a top panel portion 16. The bottom panel portion 12 includes a generally rectangular planar configuration bounded by a top horizontal edge 18, a bottom horizontal edge 20 parallel to the top edge 18, and left and right vertical edges 22, 24. The door panel portions 12, 14, 16 are typically constructed of wood, fiberboard composite, or sheet material such as sheet metal, all of which may be drilled or worked to receive new fastening hardware, as will be more fully described below. A bottom protective strip 26 having a U-shaped cross-section may be affixed to the bottom horizontal edge 20 of the bottom panel portion 12 with a plurality of fasteners 28. Optionally, a weather strip (not shown) may be affixed to the bottom protective strip 26 to bring the bottom edge of the overhead door assembly 10 into abutting sealing relationship with a floor or deck (not shown) of a trailer or storage unit to which the door assembly 10 is assembled.

Due to adverse handling or weather conditions, the bottom door panel portion 12 is often damaged at a lower corner portion 30, which typically carries a roller 32 carried by a bracket 34 affixed to the door panel portion. Such damage may include partial or total separation of the lower corner portion 30 from the bottom door panel portion 12, and in either instance requires repair and reinforcement. Likewise, the intermediate panel portion 14 may be damaged at a corner section 36 adjacent to the mounting point of an additional roller 38 or hinge 40.

Figure 2:
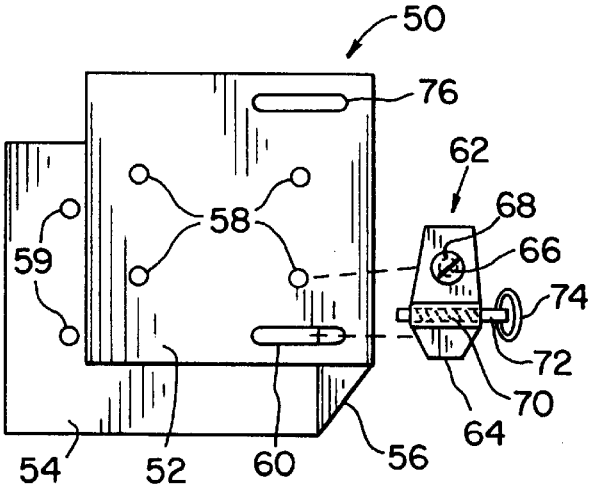
FIG. 2 is a perspective view of a first embodiment of the door sleeve of the present invention shown in an exploded view with a roller and roller bracket.
Figure 3:
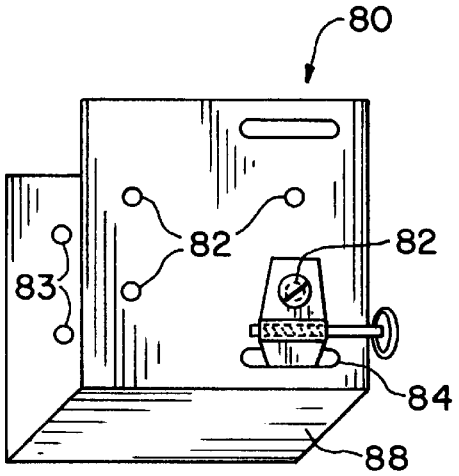
FIG. 3 is a perspective view of a second embodiment of the door sleeve shown with the roller and bracket assembled in the installed condition.

With reference to FIGS. 2 and 3, repair or reinforcement of the damaged areas 30, 36 may be readily effected by the installation of the door sleeve of the present invention. Specifically, FIG. 2 shows a generally U-shaped door sleeve 50 having a front wall 52 and a back wall 54 supported by a transverse web 56 from which the walls 52, 54 extend in substantially parallel orientation for a distance necessary to reinforcingly embrace a portion of the panel portion to which it is installed. The door sleeve 50 includes a unitary construction of 16 gauge cold-rolled steel or other sturdy, and generally weather resistant sheet material. The finished door sleeve may be primed, painted or otherwise finished to meet environmental or aesthetic requirements. According to all of the preferred embodiments, the cavity formed between the opposing faces of the front and back walls 52, 54 extending to the inside surface of the transverse web 56 has a uniform width sized to receive a standard width thickness of a door panel to be received therein. By way of example, a cavity width of about ⅞ inch will accommodate a door panel having about a ¾ inch thickness. Likewise, a cavity width of about 1 1/16 inch will accommodate a door panel having about a 1 inch thickness.

One or more pre-drilled mounting holes 58 are formed in the front wall 52 preferably in a regular pattern, and one or more mounting holes 59 are formed in the back wall 54 in opposing relationship to the front holes 58, the mounting holes 58, 59 sized and shaped to received roller and hinge hardware. As will be apparent to the skilled artisan, additional mounting holes 58, 59 may be formed in the door sleeve walls as necessary According to the present invention, at least one mounting hole 58 is provided adjacent to a slot 60 formed in the front wall 52 and adjacent to the transverse web 56. More particularly, the door sleeve of the present invention accommodates the retrofitting of a conventional roller mounting bracket 62 having a tab 64 to be received in the slot 60 and a fastener 66 extending through a fastener hole 68 to be received in the mounting hole 58 adjacent the slot 60, and extending through the entire thickness of the door panel portion to be received in a corresponding rear mounting hole 59 and secured in place with a nut or other fastener (not shown). The bracket 62 further includes a partial curvilinear bore 70 extending perpendicular to a line extending between the bracket fastener hole 68 and the tab 64, and a shaft 72 of a track-engaging roller 74 is secured within the bore 70. According to the embodiment of the invention shown in FIG. 2, it will thus be evident that the slot 60 is formed substantially perpendicular to the plane of the transverse web 56, thereby orienting the shaft 72 so that it extends perpendicular to the transverse web 56 to enable the roller 74 to engage in a track (not shown) substantially parallel to both the right vertical edge 24 of the lower panel portion 12 and the transverse web 56. According to this embodiment, a second slot 76 substantially identical to and parallel with the first slot 60 is formed in the front wall 52 adjacent to the front wall edge opposite to the edge adjacent to the first slot 60, thereby enabling the door sleeve 50 and bracket apparatus to be inverted for installation against the left vertical edge 22 in the manner so described.

Figure 4:
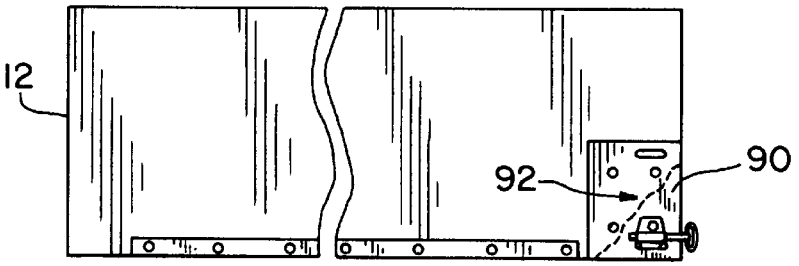
FIG. 4 is an elevational view showing either of the first or second embodiments of FIGS. 2 and 3 in the installed condition in a lower door panel of an overhead door.

FIG. 3 shows a second embodiment of the door sleeve of the present invention designated generally by the numeral 80. According to this embodiment, mounting holes 82, 83 and first and second slots 84, 86 are oriented at a 90 degree offset to the arrangement of the mounting holes 58, 59 and slots 60, 76 shown in FIG. 2, thereby allowing for the installation of door sleeve 80 at a bottom edge 20 of the lower door panel 12 of the overhead door assembly 10, whereby the transverse web 88 may be brought into abutting relationship with a portion of the bottom edge 20, if so present within the widthwise dimension of the door sleeve 80. With reference to either embodiment shown in FIGS. 2 and 3, the door sleeve 50, 80 is shown in the installed condition in FIG. 4, showing the installation of the door sleeve over a lower door panel 12 having a corner portion which was removed (shown to the right of the dashed line 92) prior to repair according to the present invention.

Figure 5:
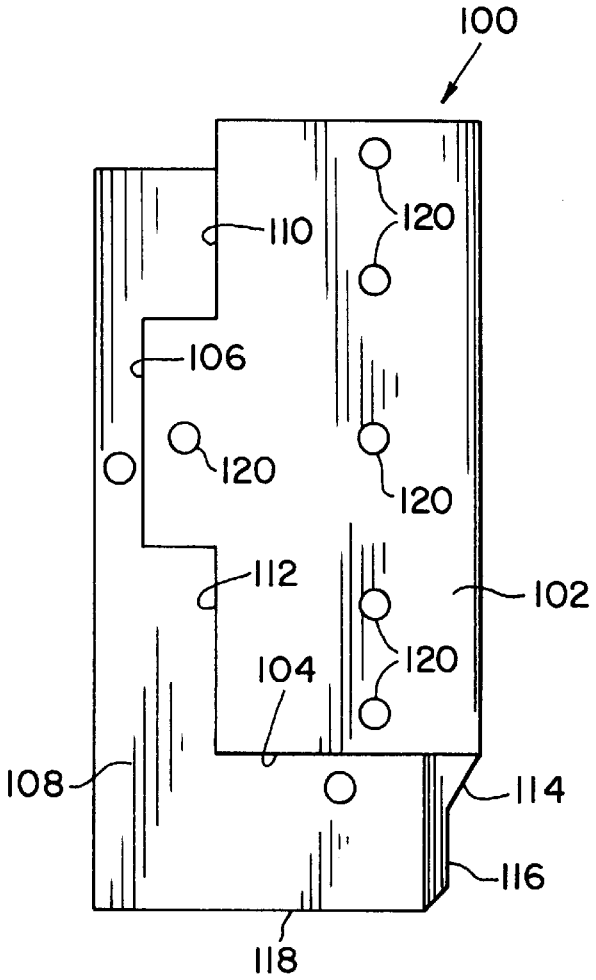
FIG. 5 is a perspective view of a third embodiment of the door sleeve of the present invention.
Figure 7:
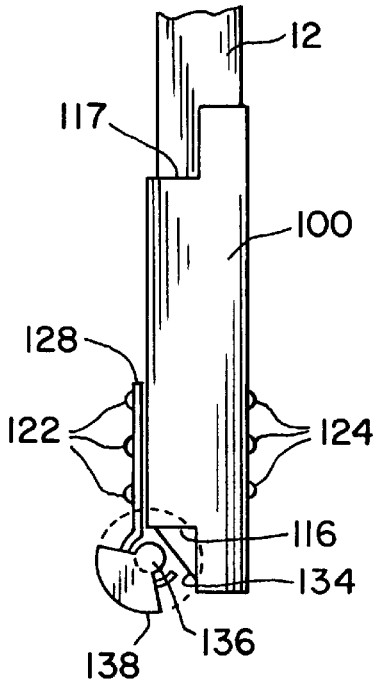
FIG. 7 is an elevational side view taken along line 7—7 of FIG. 6.
Figure 6:
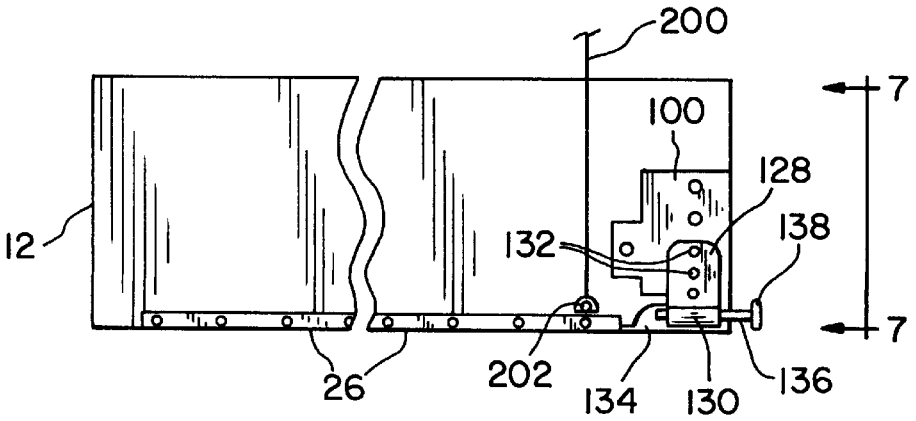
FIG. 6 is an elevational view of the door sleeve of the third embodiment shown in FIG. 5 in the installed condition in a lower door panel of an overhead door.

With reference now to FIGS. 5–7, a third embodiment of the door sleeve of the present invention is designated generally by the numeral 100. Although following the general construction of the above-described first and second embodiments 50, 80, door sleeve 100 includes a front wall 102 having a shortened bottom edge 104 and a distal side edge 106 which extends to the same width as a rear wall 108 in parallel opposing relation thereto. Orthogonal upper notch 110 and lower notch 112 are formed in the side edge 106. A transverse web 114 for supporting the front and rear walls 102, 108 is also provided with a lower notch 116 which widthwisely extends to an intermediate section of the web, and lengthwisely extends between the bottom edge 104 of the front wall 102 and the bottom edge 118 of the rear wall 108. Similarly, an upper notch 117 is formed in the upper portion of the transverse web 114 (FIG. 7). FIGS. 6 and 7 show a roller bracket 126 installed to a bottom panel portion 12 of the overhead door assembly 10. More particularly, the roller bracket 126 includes a flange portion 128 extending to a partial curvilinear bore housing 130. The longitudinal axis of the bore housing 130 is substantially perpendicular to a longitudinal axis passing through the mounting holes 132 formed in the flange portion 128. A concavity 134 is formed immediately adjacent to the bottom edge 20 of the bottom panel portion 12, and together with the lower notch 116 formed in the door sleeve 100, provides clearance for the bore housing 130, i.e., to provide necessary clearance for a roller shaft 136 extending parallel to the bottom edge 20, for supporting a roller 138 in the manner previously described for the first two embodiments of the present invention. As with the first two embodiments, the door sleeve 100 may be reversed to be applied to a left vertical edge of a door panel, whereby the roller shaft 136 and roller 138 extend from notch 117. It is further contemplated that notches 116, 117 may be sized and shaped to accommodate an oversized or overextended bottom protective strip 26. A plurality of mounting holes 120 are formed in the front wall 102 in corresponding relationship to a like number of mounting holes 121 formed in the rear wall 108 to receive selected fasteners 122 such as screws, to be secured thereto with nuts 124.

Figure 8:
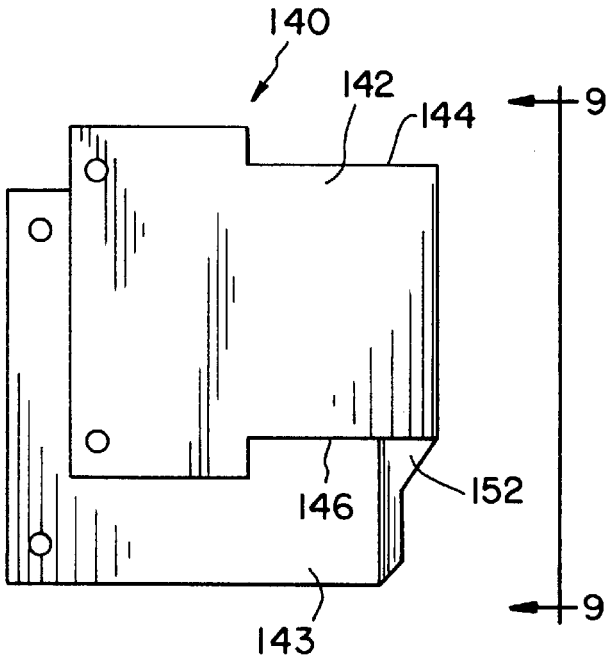
FIG. 8 is a perspective view of a fourth embodiment of the door sleeve of the present invention.
Figure 9:
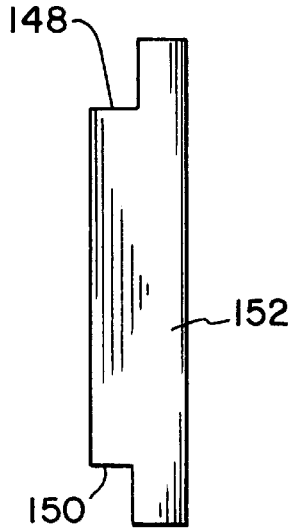
FIG. 9 is an elevational view taken along line 7—7 of FIG. 8.

FIGS. 8–11 illustrate fourth and fifth embodiments of the present invention. More particularly, FIGS. 8 and 9 show a door sleeve 140 which includes a front wall 142 having a pair of notches 144, 146 at the upper and lower edges adjacent to a transverse web 150, the front wall 142 extending substantially in parallel opposing relationship to a rear wall 143.

Each notch 144, 146 further extends to a notch 148, 150, respectively, formed in the transverse web 152 in the manner shown in connection with the third embodiment shown in FIGS. 5–7.

Figure 10:
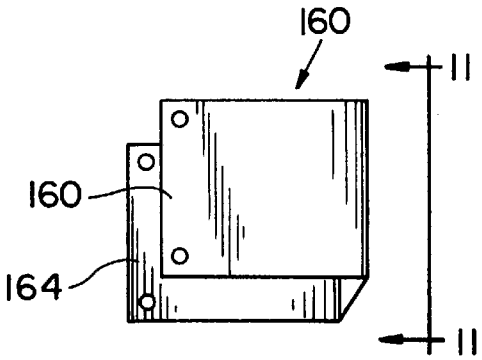
FIGS. 10 and 11 are perspective and elevational views of a fifth embodiment of the door sleeve of the present invention.
Figure 11:
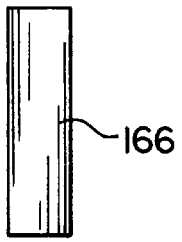

FIGS. 10 and 11 shows another door sleeve 160 having a generally equally sized and shaped rectangular front wall 162 and rear wall 164 extending in substantially parallel opposing relationship from a transverse web 166.

Figure 12:
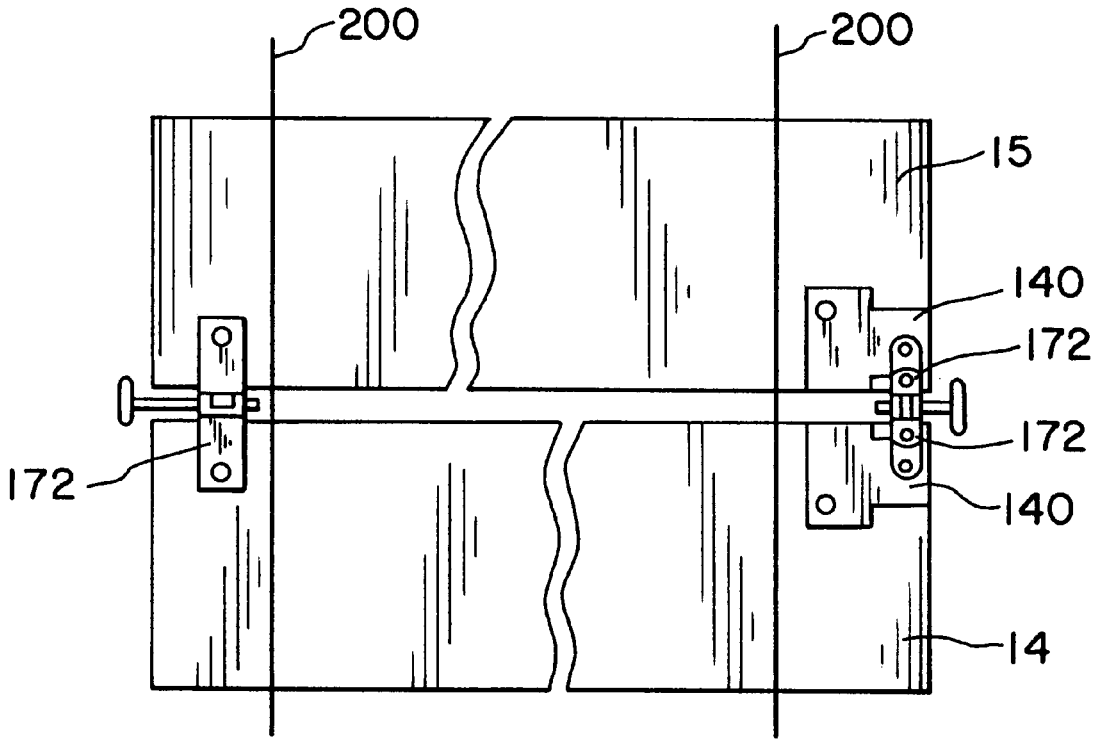
FIG. 12 is an elevational view of two door sleeves according to FIG. 8 shown assembled to intermediate portions of an overhead door.

FIG. 12 shows two door sleeves 140 installed in opposing relationship to two adjacent intermediate door panels 14, 15. More particularly, each door sleeve 140 is installed so as to receive one flange 172 of a combination hinge bracket 170. Such installation provides reinforcement of the underlying door panel, unlike the use of a conventional installation of the hinge bracket to unreinforced panel sections as shown at 172 on the left side of FIG. 12.

According to any of the disclosed embodiments, the roller bracket 62 is conventionally known as a Todco brand bracket, and the roller bracket 128 is conventionally known as a Whiting brand bracket. The Todco bracket may also include the shaft 72 of the track-engaging roller 74 in a cantilevered assembly in which the shaft 72 is secured and supported for rotation between curvilinear sections of two flanges clamped together in abutting relationship. In the installed condition and with reference to FIGS. 5–7, the web or distal side edge 106 including one of the notches 110, 112 which are formed at a comer adjacent to a selected flange to which the hinge attachment means is to be secured, enables the shaft of the roller to extend through the selected notch for engagement with a door track.

According to yet another embodiment of the present invention, the top flange portion to which the hinge attachment means is to be affixed extends laterally only to a width of the bracket, and in such a manner, remains offset from generally vertically oriented hoisting cables affixed to the door. According to this embodiment, such offset accommodates a door hoisting cable 200 which is conventionally mounted between an attachment point 202 on the door and a winch or other retraction mechanism (not shown) secured to a framework or cargo compartment to which the door is affixed. In this position, door hoisting cable 200 is generally vertically oriented and extends about 3.5 inches inwardly in parallel orientation from the outer lateral edge of the door. Accordingly, this embodiment offers a further important advantage by eliminating the prior art requirement of disconnecting such door hoisting cable 200 and attendant hardware preliminary to repairing a door panel according to the present invention. Alternatively, the top flange portion may be extended over the cable and its securing bracket to provide further reinforcement and protection thereto.

The present invention is contemplated for use with any overhead door having a plurality of linked door panels, although it will be apparent to the skilled artisan that the inventive door sleeve will be applicable to reinforcement and repair of other types of doors such as side-opening doors and sliding doors having portions thereof in need of repair and reinforcement, to which attachment hardware are to be secured.

According to the invention, the web of the door sleeve may be sized to accommodate non-insulated door panels such as cargo door panels having a nominal thickness in the range of about three quarters of an inch to one and a half inches, although lesser and greater thicknesses of such non-insulated door panels are contemplated to be repaired and reinforced by the apparatus of the present invention. Such door panel thicknesses are a function of wood or honeycomb core thicknesses, or of aluminum sheathing thickness, all of which when formed into a sandwiched construction may having varying thicknesses as is well known in the art. The invention further contemplates application to refrigerated door panels, having greater thicknesses generally dictated by insulating material incorporated therein in a sandwich construction. Such door panel thicknesses may have nominal thicknesses in the range of about 1.5 inches to 3 inches, although greater and lesser thicknesses corresponding to insulating material having improved thermal qualities (thus creating a thinner panel construction) or thicker constructions to be accommodated by the inventive apparatus are contemplated. According to any disclosed embodiment, recesses and slots for attaching the hinge attachment means are provided at mirror-image locations on opposite ends of at least one flange or wall of the door sleeve.

The door sleeve of the present invention according to any of the embodiments disclosed herein is fabricated of mild steel or aluminum sheet. Either construction may be coated with a protective or decorative finish, including powder coating, paint, electrostatic deposition coating, or a chromate finish for an aluminum construction. Fasteners and connectors used with the invention for a non-insulated or cargo door are standard 1.5 inch×0.25 inch round bolts with hex heads, or elevator bolts with flat heads. For insulated door installations, longer bolts in the range of 2.5 inches to 3 inches will be necessary to accommodate the greater thickness of those doors. Additionally, all door sleeve recesses may be round, or alternatively, square to retain hex head bolts without rotation during installation and tightening.

Although certain presently preferred embodiments of the invention have been described herein, it will be apparent to those skilled in the art to which the invention pertains that variations and modifications of the described embodiment may be made without departing from the spirit and scope of the invention.

We claim:

1. An overhead door assembly for truck and trailer overhead doors, said assembly comprising:

a plurality of door panels connected for articulation by hinge attachment means, at least one of said door panels having a panel fitting extending therefrom; and a reinforcement and repair apparatus, said apparatus comprising a sleeve having a pair of opposing flanges extending from a common web, said flanges in embracing registration with opposite sides of a portion of a door panel, said sleeve being shaped to accommodate said panel fitting.

2. The overhead door assembly of claim 1, wherein said panel fitting comprises a protective strip.

3. The overhead door assembly of claim 2, wherein said sleeve includes a notch in at least one of said opposing flanges for accommodating without interference said panel fitting.

4. An overhead door assembly for truck and trailer overhead doors, comprising:

a plurality of truck and trailer overhead door panels connected for articulation by hinge attachment means;

a reinforcement and repair apparatus, said apparatus comprising a sleeve having a pair of opposing flanges extending from a common web, said flanges in embracing registration with opposite sides of a portion of a door panel; and a roller bracket engaged with said apparatus, said roller bracket including a track engagement roller.

5. The overhead door assembly of claim 4, wherein said apparatus includes at least one attachment point on one of said flanges for engaging said roller bracket and said apparatus.

6. The overhead door assembly of claim 4, wherein each of said opposing flanges includes at least one attachment point, and wherein said roller bracket includes an attachment mechanism, said attachment points and said attachment mechanism being aligned in said overhead door assembly for attaching said roller bracket to said apparatus.

7. The overhead door assembly of claim 4, wherein each of said flanges includes an array of recesses, each recess on one of said flanges being aligned with a cooperating recess on the other of said flanges, and wherein said roller bracket includes a fastener for attaching said bracket to said reinforcement and repair apparatus through a pair of cooperating recesses.

8. The overhead door assembly of claim 7, wherein at least one of said flanges further includes a slot, and wherein said roller bracket includes a cooperating tab, said slot and said tab being aligned such that tab is received in said slot.

9. The overhead door assembly of claim 8, wherein said at least one flange includes two slots, said tab being received in a selected one of said slots.

10. The overhead door assembly of claim 4, wherein at least one of said flanges includes a notched portion.

11. The overhead door assembly of claim 4, wherein said web includes a notch at a corner thereof adjacent to a selected one of said flanges, and wherein said roller bracket is engaged with said reinforcement apparatus such that said roller bracket occupies at least a portion of said notch.

12. An overhead door assembly, comprising:

an overhead door comprising a plurality of horizontally disposed and hingedly interconnected door panels;

an apparatus for reinforcing and repairing at least one of said door panels, said apparatus comprising at least one sleeve having a pair of opposing flanges extending from a common web, said flanges in embracing relationship with opposite sides of a door panel, each of said flanges having at least one recess, said at least one recess in each said flange being in cooperating relationship with said at least one recess in the other of said flanges; and a roller bracket assembly in engagement with said apparatus, said roller bracket assembly including a track engaging roller and a fastener, said fastener extending between cooperating recesses for engaging said roller bracket assembly and said apparatus.

13. The overhead door assembly of claim 12, wherein said apparatus comprises two sleeves, each said sleeve positioned adjacent to the other of said sleeves on a separate and adjacent door panel, and wherein said roller bracket assembly engages both of said sleeves.

* * * * *